US006983524B2

(12) United States Patent
Eastwood

(10) Patent No.: US 6,983,524 B2
(45) Date of Patent: Jan. 10, 2006

(54) METHOD OF ATTACHING CANVAS TO A FRAME

(76) Inventor: Mark T. Eastwood, P.O. Box 9036, Tacoma, WA (US) 98409-0036

( * ) Notice: Subject to any disclaimer, the term of this patent is extended or adjusted under 35 U.S.C. 154(b) by 59 days.

(21) Appl. No.: 10/388,325

(22) Filed: Mar. 12, 2003

(65) Prior Publication Data

US 2004/0016103 A1 Jan. 29, 2004

Related U.S. Application Data

(60) Provisional application No. 60/363,737, filed on Mar. 12, 2002.

(51) Int. Cl.
*A47G 1/06* (2006.01)

(52) U.S. Cl. ..... 29/428; 29/525.01; 40/700; 38/102.91

(58) Field of Classification Search ..... 29/428, 29/417, 525.05, 525.01; 40/700; 38/12, 102.91, 38/102.1

See application file for complete search history.

(56) References Cited

U.S. PATENT DOCUMENTS 3,657,796 A * 4/1972 Gochnauer ..... 29/432
3,830,278 A * 8/1974 Packer ..... 160/378
3,840,167 A * 10/1974 Otteman et al. ..... 227/76
4,041,598 A * 8/1977 D'Angelo et al. ..... 29/432
4,050,498 A 9/1977 Lucchetti ..... 160/374.1
4,179,830 A * 12/1979 Lamb ..... 38/102.5
4,181,046 A * 1/1980 Lamb ..... 81/487
5,839,214 A * 11/1998 Peterson ..... 38/102.4
6,269,569 B1 * 8/2001 Doone ..... 40/603
6,347,466 B1 * 2/2002 Lackner et al. ..... 38/102.4

* cited by examiner

*Primary Examiner*—Jermie E. Cozart
(74) *Attorney, Agent, or Firm*—Seed IP Law Group PLLC

(57) ABSTRACT

A canvas framing system and method for attaching canvas to an extruded aluminum frame to achieve a taut mount painting surface, including forming the frame of aluminum material, rounding selected corners and edges of the frame, temporarily securing a first portion of the canvas to the frame and attaching the canvas to the frame, preferably with staples using a modified staple gun, stretching the canvas on the frame and temporarily securing an opposing portion of the canvas to an opposing side of the frame, which is then stapled thereto, and stretching and attaching remaining portions of the canvas to the frame with the staple gun. Cross bracing can be installed on the frame to prevent bending when the canvas is stretched taut thereon.

18 Claims, 8 Drawing Sheets

METHOD OF ATTACHING CANVAS TO A FRAME

CROSS-REFERENCE TO RELATED APPLICATION

This application claims the benefit of U.S. Provisional Patent Application No. 60/363,737 filed Mar. 12, 2002, where this provisional application is incorporated herein by reference in its entirety.

BACKGROUND OF THE INVENTION

1. Field of the Invention

The present invention is directed to a system and method for framing canvas, and more particularly, to an extruded aluminum frame with canvas mounting system that achieves a taut painting surface with a rigid, lightweight construction.

2. Description of the Related Art

It is desirable when painting on canvas to have the canvas stretched as tight and taut as possible. Typical frames, such as those made of wood, while suitable for their purpose, have difficulty retaining their shape and holding the canvas in a taut condition as the size of the frame increases. In order for such wood frames to properly function, they must be constructed of sufficiently thick and large pieces of wood that the weight becomes difficult to handle with ease.

Although lightweight composite and metal frames exist, these frames can be cumbersome to construct, require complicated steps to mount the canvas, and frequently do not retain their shape in larger sizes. Moreover, such frames can cause premature wear at points of contact with the canvas, leading to tearing of the canvas, loss of tension, and sagging of the canvas on the frame.

BRIEF SUMMARY OF THE INVENTION

The disclosed and claimed embodiments of the invention are directed to a system and method for framing canvas, and in particular to mounting canvas on an extruded aluminum frame that achieves a taut painting surface in combination with a rigid, lightweight frame suitable for wall mounting.

In accordance with one embodiment of the invention, a method of attaching canvas to a frame is provided that includes modifying a staple gun to shorten a ram component in the staple gun; forming an aluminum frame to include a plurality of sides welded together at corners; filing the corners and selected edges of the frame to present a smooth, rounded corner and edge; cutting canvas material to be sized and shaped for stretching over and attachment to the frame; temporarily attaching the canvas to one side of the frame and stapling the canvas to a staple track in the side of the frame; stretching and temporarily attaching an opposing portion of the canvas to an opposing side of the frame and stapling the canvas to the staple track in the frame on the opposing side; and stretching and attaching the remaining portions of the canvas to the frame by stapling the canvas to the staple track in the frame with the staple gun. Ideally, the canvas is stretched across the filed edges and corners of the frame.

In accordance with another embodiment of the invention, a method for attaching canvas to a frame to be suitable for painting and mounting on a wall is provided that includes forming a frame having at least four sides and a corner where adjacent sides join together to form a desired polygonal shape, the frame formed of metal material; rounding selected edges of the frame to present a smooth, round edge to prevent tearing of the canvas; cutting the canvas to the desired polygonal shape and to a size larger than the size of the frame to facilitate stretching of the canvas; stretching a first portion of the canvas over the frame and temporarily securing the first portion of the canvas to the frame; attaching the stretched portion of the canvas to the frame with fasteners positioned in a fastener track on the frame; stretching a second portion of the canvas opposing the first portion of the canvas over the frame and temporarily securing the second portion of the canvas to the frame; attaching the second portion of the canvas to the frame with fasteners positioned in the fastener track on the frame; and stretching and attaching remaining portions of the canvas to the frame with fasteners positioned in the fastener track on the frame.

In accordance with another aspect of the foregoing embodiments of the invention, a staple gun is used to attach the canvas to the frame, the staple gun ideally being modified to prevent the staple from cutting and punching through the canvas. Preferably, the staple gun is modified by reducing the length of the ram, such as filing the end of the ram.

In accordance with yet another aspect of the foregoing embodiments, the frame is preferably formed of aluminum material that is welded together. Ideally, after welding, the corners formed by welding are rounded, such as with a file, and one or more selected edges of the frame can also be rounded to present a smooth rounded surface against which the canvas is stretched to prevent tearing and premature failure of the canvas.

In accordance with yet a further aspect of the present invention, the frame is reinforced by cross bracing, ideally formed from interconnecting rods, to prevent the frame from bending when the canvas is stretched taut thereon. Preferably, the cross bracing is attached to the frame to not contact the canvas when the canvas is painted.

As will be appreciated from the foregoing, the use of aluminum provides a high strength-to-weight ratio, and the welding of the joints provides a much stronger structure than wood. This avoids the use of bracing in much larger sizes than traditionally have been accomplished with wood. Having the staple track or channel enables hiding of the staples from view and prevents a more finished appearance. In addition, using the clamps enables stretching the canvas with greater tension than manually.

BRIEF DESCRIPTION OF THE SEVERAL VIEWS OF THE DRAWINGS

The disclosed embodiments of the invention will be more readily appreciated as the same become better understood from the following detailed description when taken in conjunction with the following drawings, wherein.

DETAILED DESCRIPTION OF THE INVENTION

Figure 18:
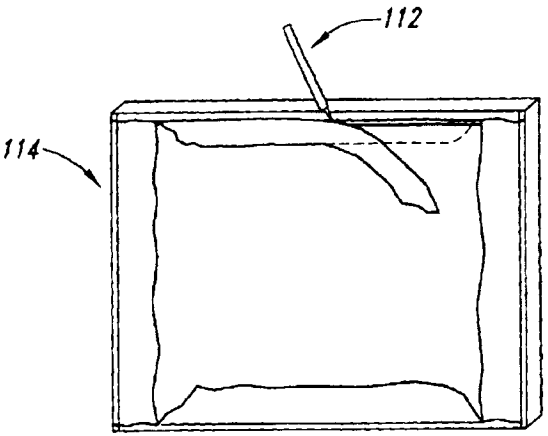
Figure 19:
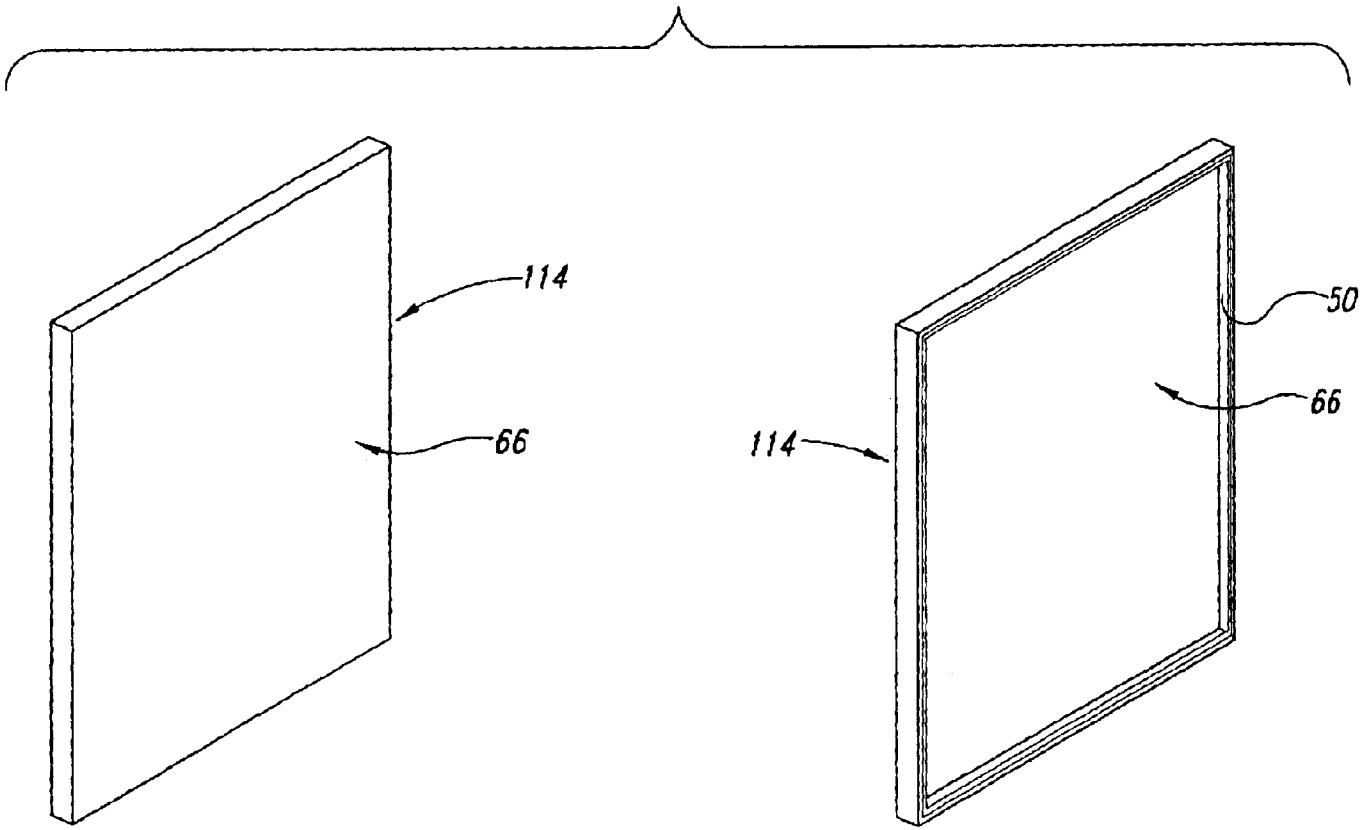

The canvas framing system 21 of the present invention is illustrated in its completed form in FIG. 19. The method for forming the canvas framing system will now be described in conjunction with FIGS. 1–18.

Figure 1:
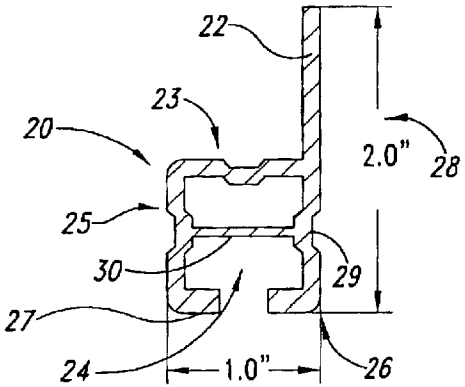
FIG. 1 is a cross-sectional view of a frame member formed in accordance with the present invention.

Referring initially to FIG. 1, shown therein is a cross-sectional view of an extruded aluminum frame member 20 having a top face 23, front face 25, bottom face 27, and back face 29. Projecting upward from the intersection of the top face 23 and back face 29 is a flange 22. The frame member 20 is a commercially available component that can be purchased from American Sun Control, Alpharetta, Ga., and is identified as a Fabri-Frame 6063 aluminum extrusion. This particular frame is also shown and described in U.S. Pat. No. 5,555,695, which is incorporated in its entirety herein by reference. The frame member 20 has a staple track opening 24 formed in the bottom face 27. Extending across an interior of the frame member 20 is a staple wall 30 that adjoins the front face 25 and the rear face 29. In a preferred embodiment, the frame member 20 has a width of 1-inch and a height of 2-inches.

Figure 2:
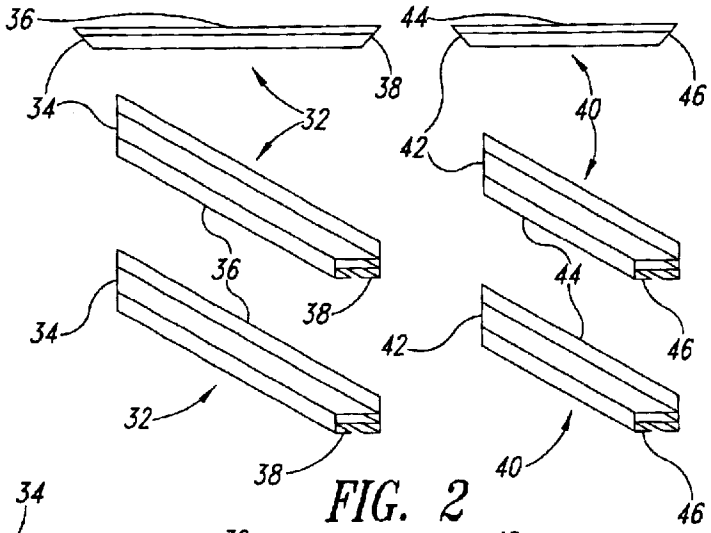
FIG. 2 is an illustration of the disassembled components of an embodiment of the framing system formed in accordance with the present invention.

Referring next to FIG. 2, shown therein are the lengths and cuts of four aluminum pieces used to construct a frame, although it is to be understood that a frame could have different number of pieces, depending on its shape and application. In order to construct the pieces, a single extrusion of aluminum 32 is placed on a miter saw base with the bottom face 27 facing down and the rear face 29 placed against a saw guide or backing plate. The aluminum piece 32 is then cut at a mitered angle 34, using a clockwise rotation of the saw's rotating base as viewed from the top. The length being cut is to the left of the blade. After putting this piece 32 on the other side of the blade and positioning it at the required length, shown with reference number 36, the other end is cut at an opposite mitered angle 38 from the first cut, using a counterclockwise rotation of the saw's rotating base. A second piece is also cut using this same technique.

Two additional pieces 40 of the required dimension are also cut having a length 44 and mitered cuts 42 and 46.

Cleaning of the pieces is ideally accomplished by holding the pieces 32 and 40 vertically and shaking aluminum shavings out of the end thereof. The pieces 32 and 40 are then cleaned, preferably with solvent. In one embodiment, rags soaked with acetone are used to wipe the entire surface of the pieces 32 and 40 to remove dirt and residue.

Figure 4:
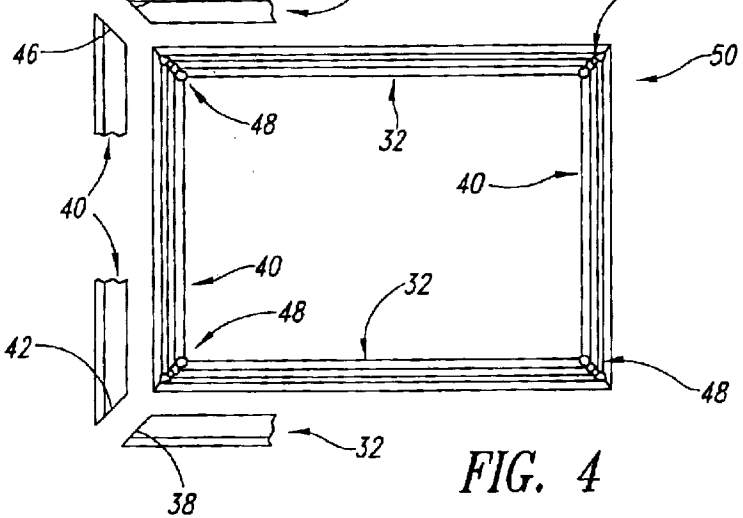
FIG. 4 is an illustration of a partially constructed frame of the present invention.
Figure 3:
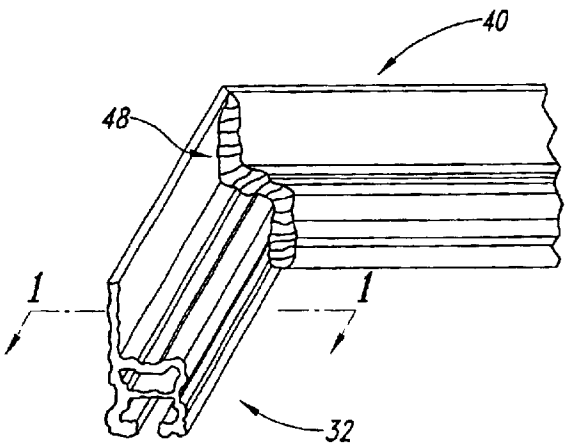
FIG. 3 is an isometric view in partial cross-section of a corner construction of a frame in accordance with the present invention.

The pieces are then welded together, as shown in FIG. 3. A piece 32 and a piece 40 are welded at the miter joints 34 and 46 and at 38 and 42, as shown in FIG. 4. To accomplish the welding step, the two adjacent pieces 32 and 40 are clamped together flange-up on a flat table. Preferably, a TIG welder is used to weld the inside joint 48. The process is repeated for the other joints.

The welded sections are then fitted together to make a desired shape. The remaining joints are welded in the same manner. FIG. 4 shows the front view of a welded frame 50.

Figure 5:
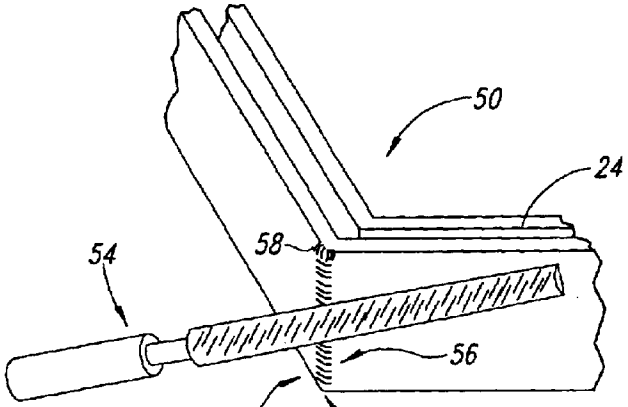
FIG. 5 is an illustration of one step of the method of the present invention for forming round corners.

To smooth the corners and prevent the canvas from tearing on the burred edges, the frame 50 is now filed at the corners 52. The filing process begins as shown in FIG. 5 on the frame 50. While supported on supports, such as two sawhorses, the frame 50 is placed face-down. At a first corner 52 a bi-metal file 54 is used to smooth the corner edge 56. The 2-inch edge 56 is rounded off to a ⅛-inch radius. The back corner 58 is also rounded to the same radius. All other back corners and corner edges are rounded in the same manner.

Figure 6:
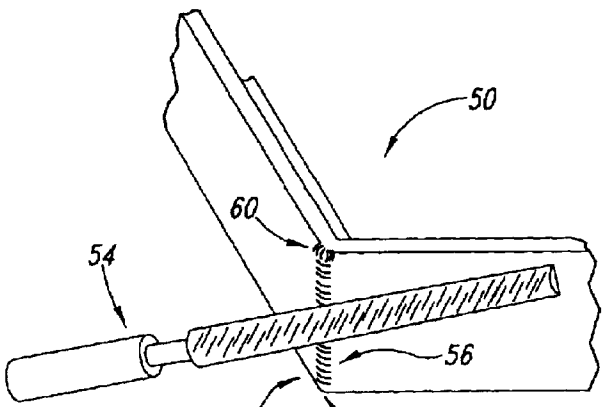
FIG. 6 is a subsequent step of FIG. 5 showing the rounding of a corner on the frame in accordance with the present invention.

The frame 50 is then turned over to the face-up position, as shown in FIG. 6, for filing of the front side. The front corner 60 is filed and rounded in the manner described above, as are the other three front corners. With all corners and edges filed as described above, the frame 50 is now ready to have the canvas mounted thereon.

Figure 7:
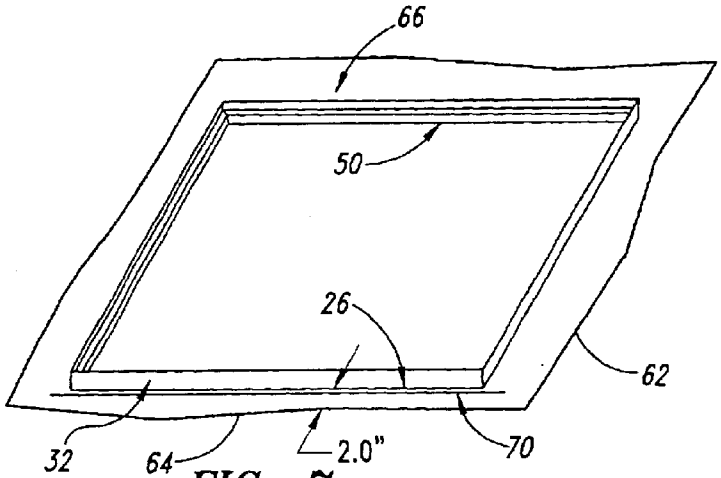
FIG. 7 illustrates the completed frame placed on a sheet of canvas material.

In most embodiments, the canvas material that is used is a #10 cotton duck canvas. Referring next to FIG. 7, the canvas is rolled off the canvas roll and cut along line 62 a foot longer than the length of the frame 50, which means approximately 6-inches longer on each end of the frame 50, to provide sufficient extra material to grasp for stretching. The cut at 64 is also made approximately 1 foot longer. The canvas 66, after it is cut, is laid flat on a work surface, as shown in FIG. 7. The frame 50 is placed on top of the canvas 66, either in a face-up or face-down position. One side 32 of the frame 50 is placed approximately 2-inches from the cut edge 64 of the canvas 62. The frame 50 should be centered along its length on the canvas 66. A line 70 is drawn on the canvas 66 along the outside edge 26 of the side 32 of the frame 50. The canvas piece 66 is now ready for stretching.

Figure 8:
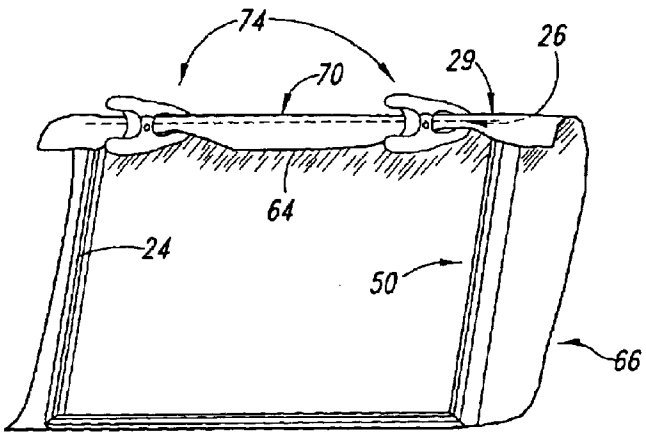
FIG. 8 shows the frame of FIG. 7 clamped to the sheet of canvas along one side.

The canvas 66 is stretched onto the aluminum frame 50, as seen in FIG. 8. The frame 50 is set against a wall or other supporting surface face-in and having the long dimension in a horizontal orientation. The canvas 66 is placed over the top of the frame 50 and behind it, as shown in FIG. 8. The drawn line 70 on the canvas should be showing at the top back edge 26 of the frame 50. The side 64 of the canvas 66 will be along the top edge of the frame 50. Using two spring clamps 74 (Pong model no. 3202), one at each end, the canvas 66 is secured to the top face 29 of the frame 50 and centered lengthwise.

Figure 9:
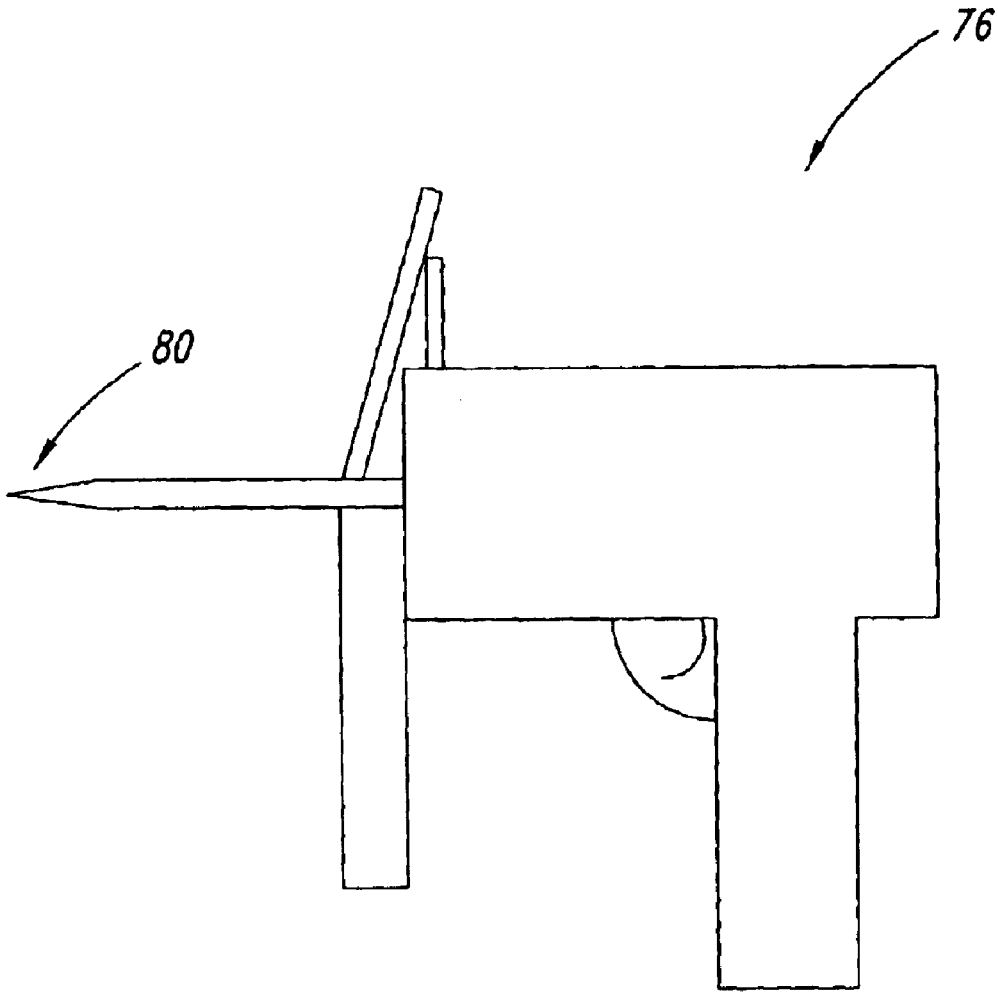
FIG. 9 illustrates a staplegun modified in accordance with the present invention.

The canvas 66 is then stapled onto the frame 50 using an air-powered staplegun 76. In a preferred embodiment, a Senco model no. SLS20 with Senco L06BAB staples 78 is used. As shown in FIG. 9, the staplegun 76 must be modified so that the movable ram 80 (the component that shoots the staple out of the staple gun 76 when the trigger is pulled) is filed back approximately 1/16-inch. This prevents the entire staple from punching through the canvas 66 and cutting the canvas 66. The pressure in the air compressor used with the staplegun 76 should be at approximately 60 psi.

Figure 10:
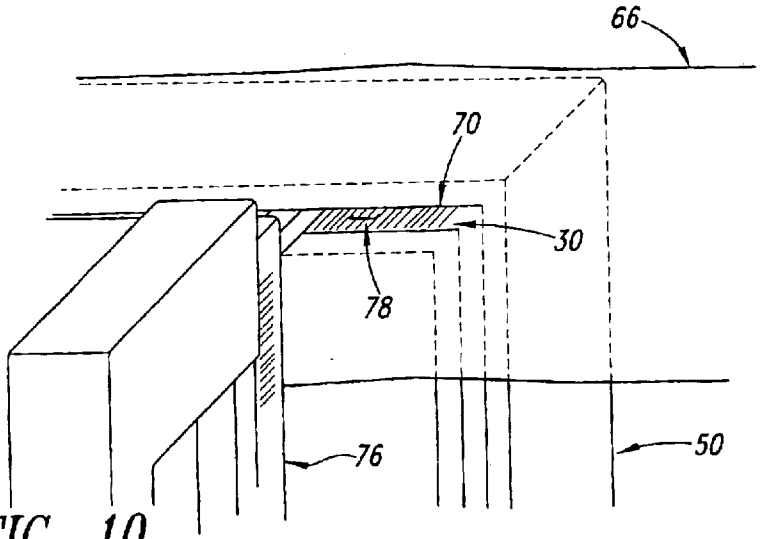
FIG. 10 illustrates the staplegun of FIG. 9 positioned to attach the canvas to the frame of FIG. 7.

Referring next to FIG. 10, the staplegun 76 is held at one end of the staple track 24. The spring clamp 74 is removed from that end of the frame and (with the canvas 66 and the staplegun 76 positioned in the staple track 24) adjust the position of the canvas 66 so that the drawn line 70 is positioned at the bottom center of the staple wall 30. When the canvas 66 is correctly positioned, two staples 78, positioned approximately 2-inches from the end of the side track 24, are installed.

Figure 11:
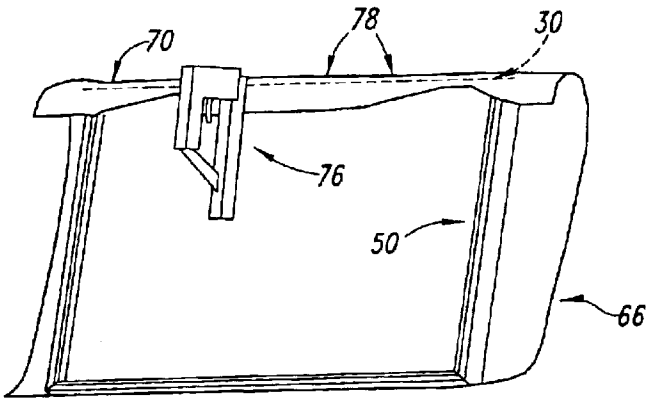
FIG. 11 shows the attachment of staples to the canvas and the frame.

Referring next to FIG. 11, while keeping the drawn line 70 at the center of the staple wall 30, the canvas 66 is pulled tight horizontally and stapled at 3-inch intervals, as shown by the staples 78. The other spring clamp 74 is removed when half of the side of the canvas 66 is stapled. Stapling is continued until 2-inches from the end of the frame 50. All vacant spaces are then stapled, except the ends, at 1-inch intervals.

Figure 12:
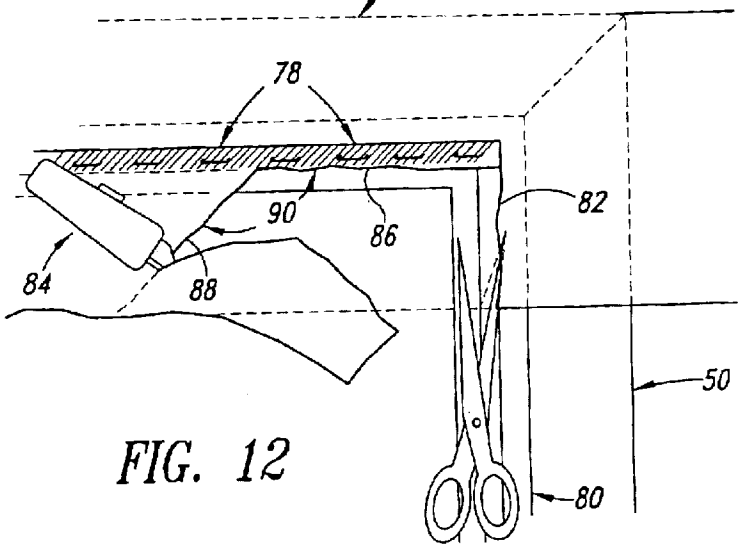
FIG. 12 illustrates trimming and cutting of the canvas after attachment to the frame.

FIG. 12 shows the next step. At one end, the canvas 66 is pulled tight. With the use of scissors 80, a cut 82 is made along an outside edge of the canvas adjacent the staple track 24, and ¼-inch past the drawn line 70, as shown in FIG. 12. While still pulling the canvas horizontally 66, two staples 78 are installed in each end section. This procedure is repeated at the other end.

Figure 13:
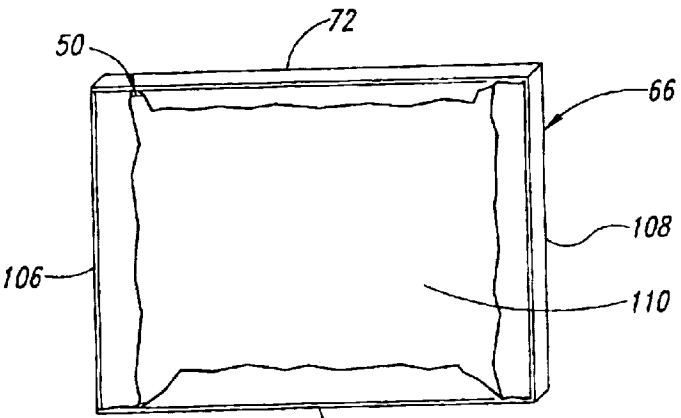
FIG. 13 shows the partially assembled canvas on the frame.

Still referring to FIG. 12, and starting at an intersecting corner of the staple track 24, a utility knife 84 is used to make a 3-inch cut 86 along the inside edge of the staple track 24 to release the excess canvas. A cut 88 is then made to the edge of the canvas 66 at approximately a 135° angle 90 to the previous cut 86. The above process is repeated at the other end of the side 32. The first side 64 of the canvas 66 is now stapled to the side 32 of the frame 50, as seen in FIG. 13.

Figure 14:
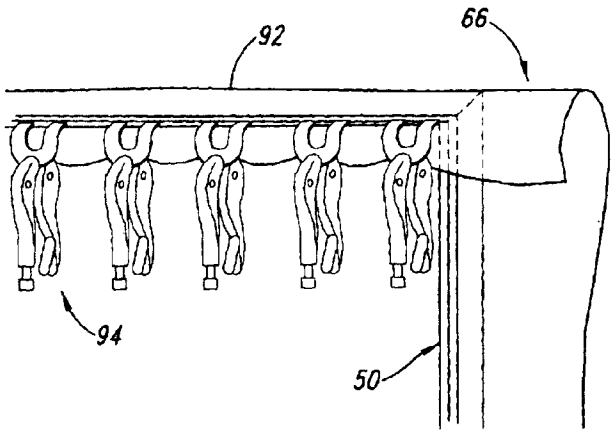
Figure 15:
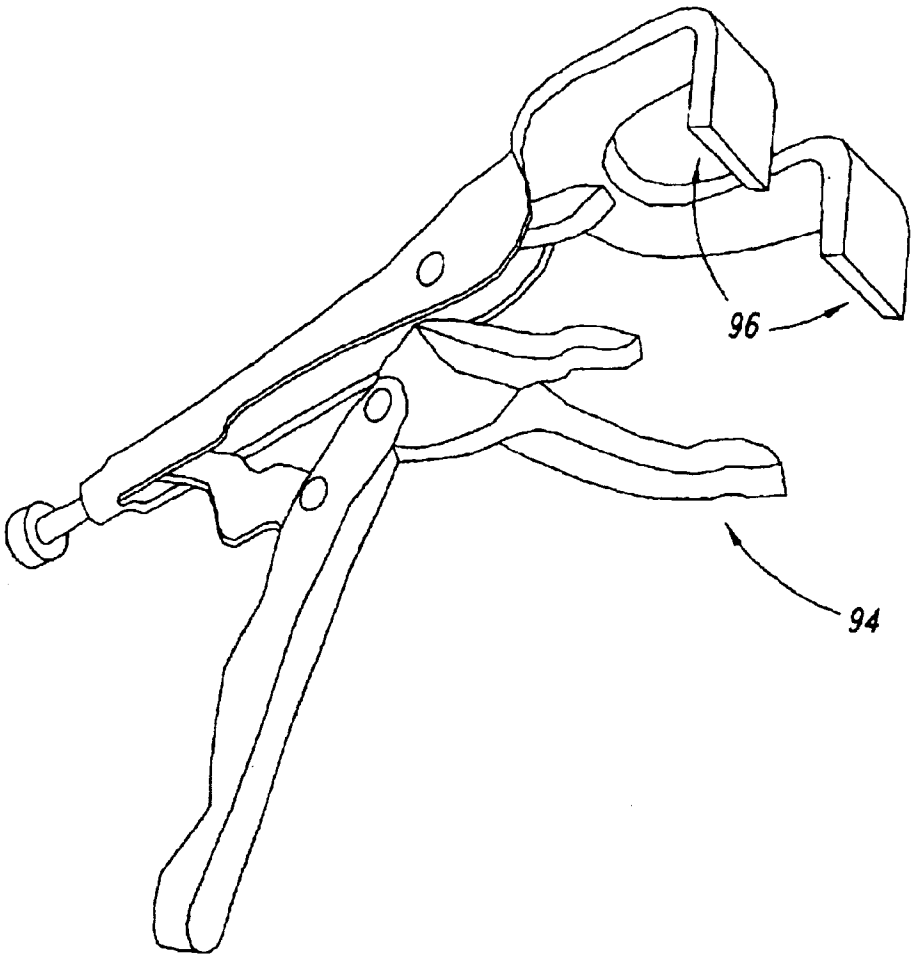

Next, the frame 50 with the canvas 66 is inverted (turned 180°). Referring next to FIG. 14, the canvas 66 is pulled tight at the midpoint of the length 92 of the frame 50. Using a Vice-Grip clamp 94 (preferably model no. 9R with two 90° bent fingers 96 as shown in FIG. 15), the canvas 66 is fastened to the frame 50 with the clamp fingers 96 in the staple track 24. The clamp fingers 96 must also be filed at the end, as shown in FIG. 15, so they do not tear the canvas 66.

Working on one-half of this side 92, the canvas 66 is pulled tight and secured with clamps 94 at 5-inch intervals until the corner is reached.

Starting with the second clamp 94 from the center, the canvas 66 is retightened and reclamped with vice-grips 94 to the frame 50. With several clamps 94 on the frame 50, it allows the canvas 66 to be tightened gradually. This is repeated two or three times until the canvas 66 is extremely taut.

A cut 82 is made adjacent the staple track 24, as shown in FIG. 12. Three staples 78 are put between each clamp 94, and one staple 78 is placed on the outside of the second and corner clamps 94. All clamps 94 are removed except the center clamp, and three staples 78 are put in each vacant space, approximately 1-inch apart in this embodiment. Two cuts 86, 88 are made on the end as described above in conjunction with FIG. 12.

The above procedure is repeated for the second half of this side 92, but also stapled on each side of the center clamp and in the vacant space when the center clamp is removed. The second side 92 is now stretched on, as seen in FIG. 13.

Figure 16:
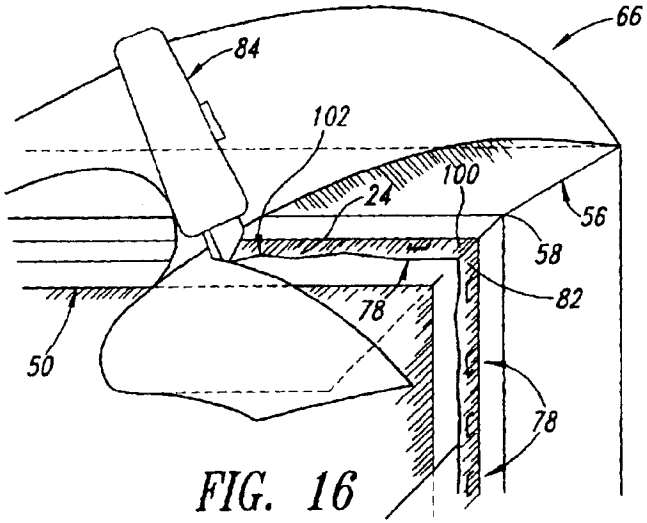
FIGS. 14–19 show the finishing steps of attaching the canvas to the frame in accordance with the method of the present invention.

The frame is then turned a quarter turn (90°). As shown in FIG. 16, working at either corner, the canvas 66 is pulled tight around the 2-inch edge 56. The canvas edge 82 is then pulled, after folding it under ½-inch at a mitered angle from the corner 58 of the frame 50 and down the staple track 24 miter. The resulting flap 100 is then stapled 78 into the staple track 24. Using a utility knife 84, the excess canvas is trimmed off the flap 100 along the inside edge of the staple track 24, and it is cut along edge 102.

Figure 17:
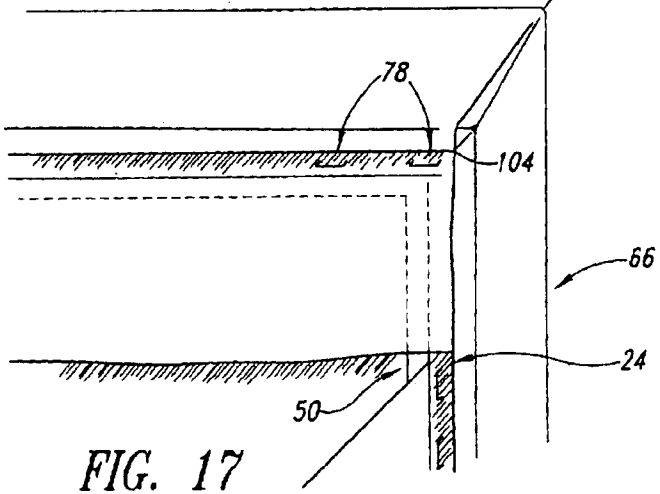

As illustrated in FIG. 17, the remaining canvas 66 starting from the front corner 60 is folded, and this edge is pulled to the outside edge of the adjacent staple track 24. This flap 104 is then stapled into the staple track 24 with two staples 78. For the other corner on this side 106, the above process is repeated, as shown in FIGS. 16 and 17.

For the remaining length of this side 106 of the canvas 66, the process as described for the second side 92 is repeated, except for the corner-procedure because the corners are already completed. The third side 106 is now stretched on.

For the last side 108, the procedure described for the third side 106 is repeated. The canvas 66 is now stretched onto the frame 50 as illustrated in FIG. 13.

The canvas 66 is now ready to be trimmed along the back. The stretched canvas 110 is standing with the back face showing and the front face towards the wall. As seen in FIG. 18, a sharp knife 112, such as an X-acto knife with a #11 blade is used. Starting on either of the sides 64, 92, 106, or 108, the entire length of the canvas 66 along the inside edge of the staple track 24 is trimmed. This process is repeated on the other three remaining sides. The canvas 66 is now trimmed in the installed configuration.

FIG. 19 shows the front and back views of the framing system 114 that includes the frame 50 and the stretched canvas 66, in this case a quadrilateral example.

It is to be understood that while a preferred embodiment of the invention has been illustrated and described, various changes may be made therein. For example, the frame may have any polygonal shape, or it may be circular or oval.

Figure 20:
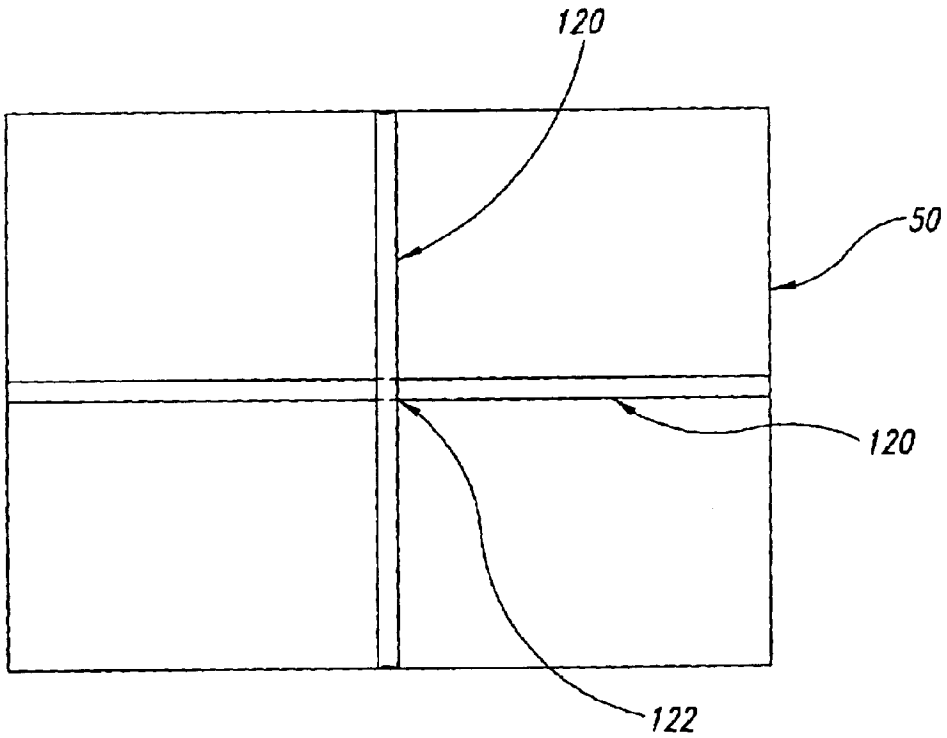
FIG. 20 shows another embodiment of the invention.

In situations where the frame is larger than 4 feet along any side, reinforcing members should be used. These reinforcing members are shown in FIG. 20 as cross braces formed of solid round aluminum rods 120 that are attached at the back of the frame 50 and intersect each other across the center of the back. The intersection 122 of the rods 120 may be formed in any conventional manner. In frames larger than 8 feet, a meshwork of reinforcing rods may be used, in which case the center section should be left open in order to prevent interference with the canvas as it is pushed by the brush when being painted. In other words, it is undesirable to have the canvas contact the tubular reinforcing rods 120 when being painted.

From the foregoing it will be appreciated that, although specific embodiments of the invention have been described herein for purposes of illustration, various modifications may be made without deviating from the spirit and scope of the invention. Accordingly, the invention is not limited except as by the appended claims and the equivalents thereof.

What is claimed is:

1. A method of attaching canvas to a frame to be suitable for painting and mounting, comprising:

providing a sheet of canvas;

forming a frame having at least four sides and a corner where adjacent sides join together to form a desired polygonal shape, the frame formed of metal material;

rounding selected edges of the frame to present a smooth, round edge to prevent tearing of the canvas;

cutting the canvas to the desired polygonal shape and to a size larger than the size of the frame to facilitate stretching of the canvas;

stretching a first portion of the canvas over the frame and temporarily securing the first portion of the canvas to the frame;

attaching the stretched portion of the canvas to the frame with fasteners positioned in a fastener track on the frame;

stretching a second portion of the canvas opposing the first portion of the canvas over the frame and temporarily securing the second portion of the canvas to the frame;

attaching the second portion of the canvas to the frame with fasteners positioned in the fastener track on the frame; and stretching and attaching remaining portions of the canvas to the frame with fasteners positioned in the fastener track on the frame.

2. The method of claim 1 wherein stretching and attaching remaining portions of the canvas comprises attaching the canvas at each corner of the frame by stretching the canvas across the corner, forming a folded-under flap from the canvas stretched across the corner and attaching the folded-under flap with fasteners to the fastener track of the frame, cutting the canvas at the corner to remove excess canvas, and stretching and attaching the remaining canvas adjacent the corner of the frame with fasteners positioned in the fastener track.

3. The method of claim 1 wherein stretching and attaching remaining portions of the canvas comprises alternatingly stretching and temporarily attaching the canvas to the frame until the canvas is at a desired tautness on the frame.

4. The method of claim 1 wherein attaching the canvas to the frame comprises stapling the canvas to a staple track in the frame using a staple gun.

5. The method of claim 4, comprising an initial step of modifying the staple gun to prevent the entire staple from punching through the canvas.

6. The method of claim 5 wherein modifying the staple gun comprises reducing the length of a ram in the staple gun.

7. The method of claim 4, comprising using a pneumatic staple gun at 60 psi.

8. The method of claim 1, comprising reinforcing the frame with cross braces to prevent bending of the frame when the canvas is stretched across the frame.

9. The method of claim 1 wherein cross braces are positioned on the frame to prevent contact with the canvas when the canvas is being painted.

10. A method of attaching canvas to a frame, comprising:

forming a lightweight metal frame having a staple track formed within the frame;

stretching and clamping canvas to the frame;

modifying a staple gun to prevent an entire staple from punching through the canvas; and stapling the canvas to the staple track on the frame with the modified staple gun.

11. The method of claim 10 wherein forming the frame comprises forming the frame of aluminum material.

12. The method of claim 10 wherein forming the frame comprises forming a reinforcement on the frame to prevent bending of the frame when the canvas is stretched on the frame.

13. The method of claim 10 wherein the step of modifying the staple gun comprises shortening a ram in the staple gun.

14. A method of attaching canvas to a frame, comprising:

modifying a staple gun to shorten a ram component in the staple gun;

forming an aluminum frame to include a plurality of sides welded together at corners;

filing the corners and selected edges of the frame to present a smooth, rounded corner and edge;

cutting canvas material to be sized and shaped for stretching over and attachment to the frame;

temporarily attaching the canvas to one side of the frame and stapling the canvas to a staple track in the side of the frame;

stretching and temporarily attaching an opposing portion of the canvas to an opposing side of the frame and stapling the canvas to the staple track in the frame on the opposing side; and stretching and attaching the remaining portions of the canvas to the frame by stapling the canvas to the staple track in the frame with the staple gun.

15. The method of claim 14 wherein stretching and attaching the remaining portions of the canvas to the frame comprise attaching the canvas across the corners of the frame by stretching a portion of the canvas across the corner, folding under a stretched portion of the canvas and stapling it to the staple track in the frame, cutting the canvas at the corner to remove excess material and form a straight edge to facilitate stretching an attachment of the remaining portion of the canvas to the frame.

16. The method of claim 14 wherein the canvas is temporarily attached to the frame with spring clamps.

17. The method of claim 14 wherein the canvas material is temporarily attached to the frame with clamps that force the canvas into the staple track in the frame.

18. The method of claim 14 wherein stretching and attaching the remaining portions of the canvas comprises alternatingly stretching and temporarily securing the remaining portions of the canvas to the frame until the canvas is at a desired tautness on the frame.

* * * * *